United States Patent [19]

Chen

[11] Patent Number: 4,654,922

[45] Date of Patent: Apr. 7, 1987

[54] BRUSH WITH UNIVERSAL JOINTS

[76] Inventor: Horng Y. Chen, 1, 4th Floor, No. 12, Lane 348, Min Chun East Road, Taipei, Taiwan, 104

[21] Appl. No.: 738,275

[22] Filed: May 28, 1985

[51] Int. Cl.[4] ..... A46B 9/04

[52] U.S. Cl. ..... 15/172; 15/144 A; 15/201; 15/176

[58] Field of Search ..... 15/167 R, 201, 202, 15/203, 172, 176, 144 R, 144 A

[56] References Cited

U.S. PATENT DOCUMENTS 1,658,383 2/1928 Lewis ..... 15/172

2,022,039 11/1935 House ..... 15/144 A 4,330,896 5/1982 Booth ..... 15/167 R X

FOREIGN PATENT DOCUMENTS 279994 11/1914 Fed. Rep. of Germany ..... 15/172

693001 8/1930 France ..... 15/144 A

*Primary Examiner*—Peter Feldman

[57] ABSTRACT

A brush divided into three sections and four independent pieces, is joined by many alternative joints. At each joint the brush can be bent upward or downward or turned to any direction to achieve some special functions of brushing or cleaning in a limited working space for which the conventional brush can not attain.

10 Claims, 20 Drawing Figures

BRUSH WITH UNIVERSAL JOINTS

BACKGROUND OF THE INVENTION

The present invention relates to toothbrushes in which the brush head is adjustable relative to the handle so that the hard-to-get-at areas of the teeth, the "dead corners", can be easily cleaned. The conventional brush and its handle are made in one piece. Usually it is very difficult to clean certain of these "dead areas" due to the limited working space. The toothbrush of the present invention is divided into four pieces. The first piece is the handle, the second piece is the neck and about $\frac{3}{4}$ths of the rear portion of the brush head, the third and fourth pieces are the two detachable and pivotable side-by-side pieces that occupy about $\frac{1}{4}$ of the front part of the brush head. The handle and neck pieces are pivotally jointed to each other by the various universal joints of the present invention.

SUMMARY

The conventional tooth brush can hardly clean the most inner teeth in the mouth. However, if the present invention, a tooth brush with the head bent, is applied, any tooth (including the most inner ones) in the mouth can be easily cleaned.

Besides the bending of the head of the brush, it can also be bent at the neck. Thus more brush efficiency can be obtained.

The object of the present invention is to be able to clean the "Dead corner" by the bent head of the brush when the working space is limited.

The other object of the present invention is to be able to clean other small "Dead corner" by the turnable front part of the brush.

DESCRIPTION OF THE PREFERRED EMBODIMENT

The present invention can be applied to various kinds of brushes, but the tooth brush is now taken as an example. The detailed description is given below.

The present invention is divided into three sections: (1) the handle 10, (2) the neck and the rear major part (about $\frac{3}{4}$) of the brushing area 3, (3) the two turning pieces 1 (the front minor part of the brushing area 3 (about 174)). Therefore the present invention is again divided into four independent pieces (see FIG. 1).

Figure 5:
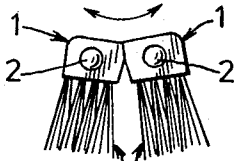
FIG. 5 is a view similar to FIG. 4 but with the turning pieces turned outwardly.
Figure 4:
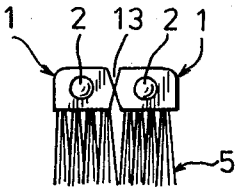
FIG. 4 is a cross-sectional view taken along line A—A of FIG. 3.

The two turning pieces 1 are equal in size, and each of them has a plain ball joint 2. In the front of the brush body 5 there are two plain ball sockets 4 side by side (see FIG. 1). They are prepared for receiving the two plain ball 2. After joining together, the two turning pieces 1 can be turned inward or outward (see FIG. 5). The two turning pieces 1 can be concurrently bent downward (see FIG. 2) to increase the brushing strength. The cuts 13, 14 are prepared (see FIGS. 3–6) to make the bending easy.

Figure 7:
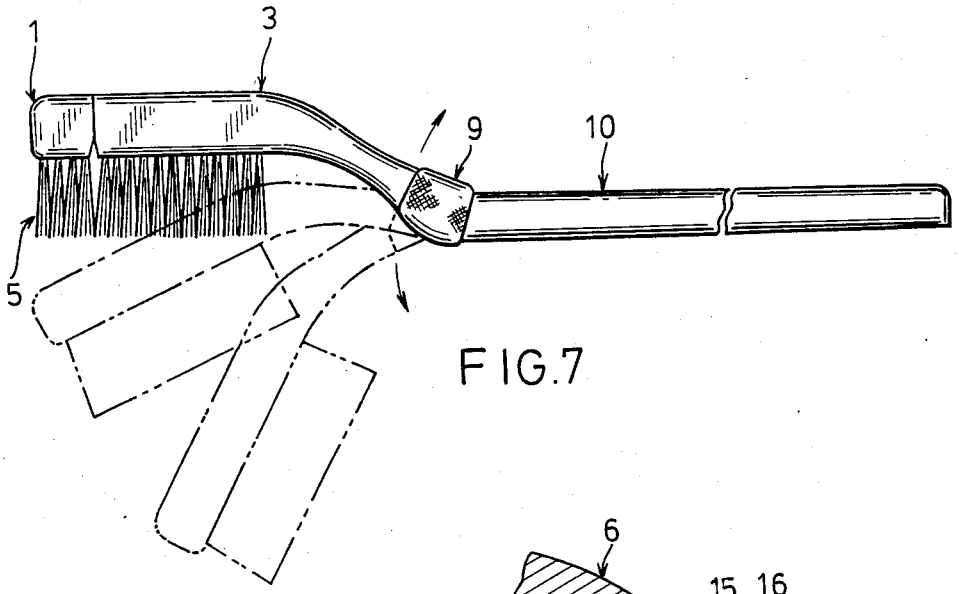
FIG. 7 is a side view thereof showing the neck in different positions.

At rear part of the neck 6 five alternative joints can be set to make the brush body 5 can be either bending or turning or the tooth combined (see FIG. 7) to meet the different requirements in operation.

The five alternative joints are described one after the other as follows.

(1) Ratchet ball joint

Figure 1:
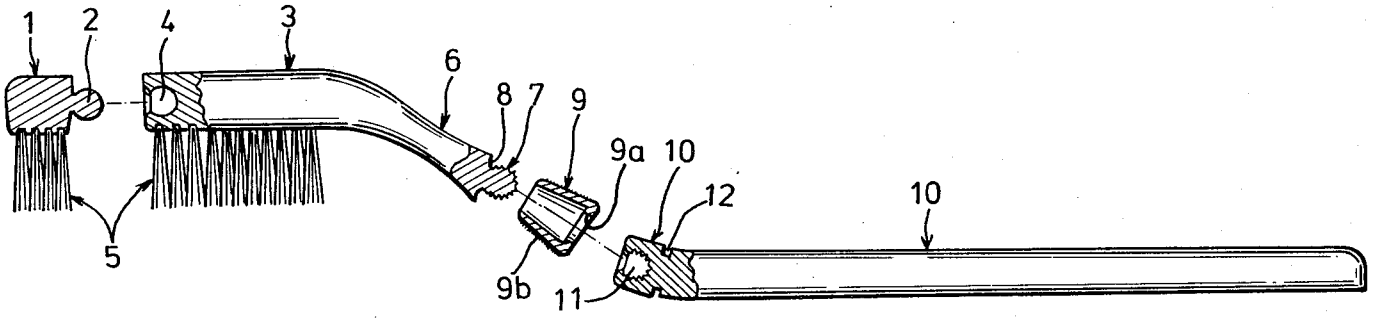
FIG. 1 is a side elevation of the present invention showing the parts in an exploded view.
Figure 2:
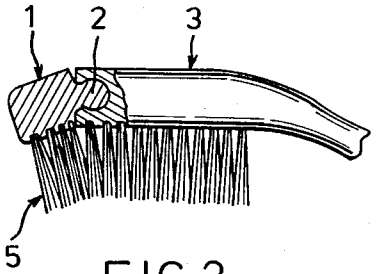
FIG. 2 is a partial view thereof showing the brushing area having the turning pieces connected to said brushing area.
Figure 3:
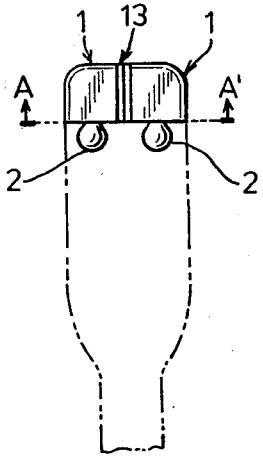
FIG. 3 is a top view of the brushing area.
Figure 6:
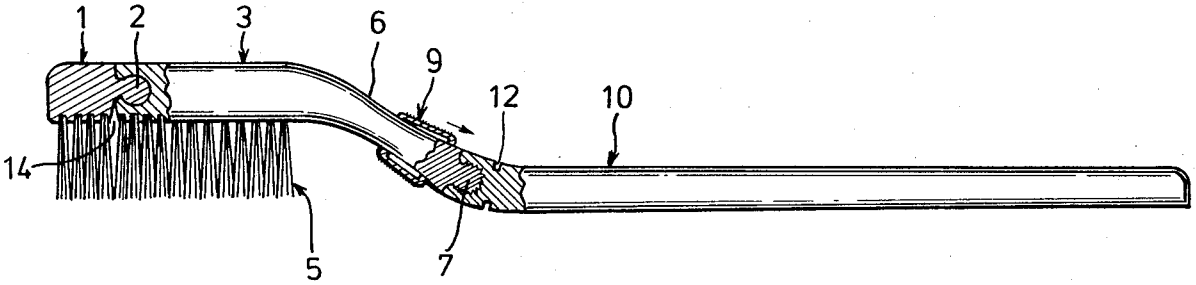
FIG. 6 is a side view of the present invention partly in section.

FIGS. 1 and 6 are referred.

A ratchet ball 7 is fixed at the right end of the neck 6, and a correspondent ratchet ball socket 11 is prepared inside the left end of the handle 10. On the surface of the ratchet ball 7 there are net-like protruded round prisms, and on the surface of the ratchet ball socket 11 there are net-like troughs. These prisms and troughs are matched each other. Therefore when the ratchet ball 7 is inset by force into the ratchet ball socket 11, then the joint is well joined and can be turned to any direction. When turning, the two nets are moved relatively and some sound can be heard.

A special sleeve 9 is set around the joint to increase the strength of the joint (see FIG. 1). Inside the sleeve 9 there is a sleeve inner rim $9_a$ and at the left end of the handle 10 there is a circular trough 12 is also prepared, thus when the sleeve inner rim $9_a$ is moved into the circular trough 12 then the sleeve 9 is set at its proper position. On both sides of the sleeve 9 there are deformed plates $9_b$. They can prevent from slipping when the fingers are pressed on them.

(2) Polyhedron ball joint

Figure 9:
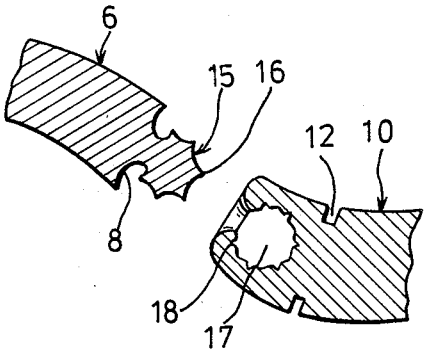
FIG. 9 is a sectional view of the polyhedron ball joint unassembled.
Figure 8:
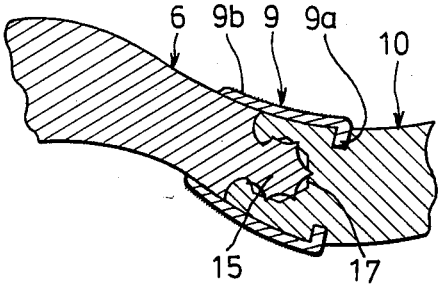
FIG. 8 is a sectional view of a second alternate joint at the neck portion in the form of a polyhedron ball joint.

The FIGS. 8 and 9 are referred.

The polyhedron ball joint is approximately same as the ratchet ball joint as described above except the contact surfaces. A polyhedron ball 15 is fixed at the right end of the neck 6 and a correspondent polyhedron ball socket 17 is prepared at the left end of the handle 10. The plastic prisms 16 on the polyhedron ball 15 is tough to some suitable extent. The troughs 18 on the surface of the polyhedron ball socket 17 are designed to match the plastic prisms 16. Therefore when the polyhedron ball 15 is inset by force into the polyhedron ball socket 17, then the joint is well joined and can be turned to any direction. When turning the plastic prisms 16 and the throughs 18 are moved relatively and some sound can also be heard.

Same as the ratchet ball joint a special sleeve 9 is prepared (see FIGS. 6, 8, and 9) for increasing the strength at the joint.

(3) Circular tough rod joint

Figure 10:
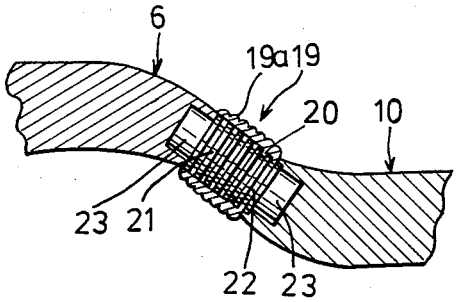
FIG. 10 shows a sectional view of a third alternate of the neck joint with a round sleeve.

FIG. 10 is referred.

The circular tough rod 21 commonly used at the desk lamp can be applied here. Therefore the brush body 5 can be turned universally.

However same as the ratchet ball joint a circular tough rod sleeve 19 is prepared. On the outer surface of the circular tough rod sleeve 19 the wavy troughs $19_a$ are prepared for the purpose of the prevention from slipping of the fingers when the fingers are pressed on them.

At the right end of the circular tough rod sleeve 19 there is a two-round male thread 20 on its inner face, meanwhile there is a set of female thread 22 on the outer surface of the circular tough rod 21. The two set male thread 20 and female thread 22 can match each other. Thus the circular tough rod sleeve 19 can be moved along the circular tough rod 21 when the sleeve 19 is turned by hand round the female thread 22. Then the strength of the circular tough rod 21 can be increased and adjusted. The jointing heads 23 at the both ends of the circular tough rod 21 can be inset into the handle 10 and the neck 6 by common method.

(4) Flat tough rod joint

Figure 11:
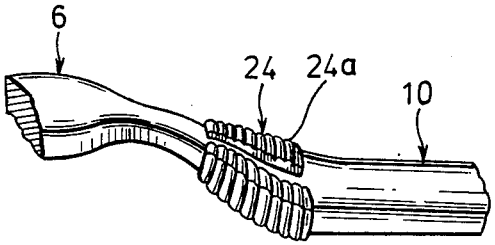
FIG. 11 is a partial perspective view of a fourth alternate joint showing a flat sleeve.
Figure 12:
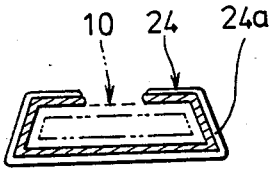
FIG. 12 is a cross-section of the flat sleeve in FIG. 11.

FIGS. 11 and 12 are referred.

The flat tough rod joint is similar to the circular tough rod joint as described before except the forms in their cross sections. The cross section of the flat tough rod joint is flat (see FIG. 12). The flat tough rod may not be strong enough, then a flat tough rod sleeve 24 is applied. On both sides of the flat tough rod sleeve 24 there are also the wavy troughs $24_a$ for the purpose of preventing from slip of the fingers.

(5) Drum wheel joint

FIGS. 13–18 are referred.

The drum wheel joint is approximately same as the ratchet ball joint and the polyhedron ball joint except the ball. A drum wheel 27, 30 is used instead of the balls in the former two joints. On the circumferential surface of the drum wheel 27, 30 there are parallel round prisms $27_a$, $30_a$ all round the drum wheel 27, 30. At the left end of the handle 10 there is a drum wheel socket 28, 32, which can receive the drum wheel 27, 30. On the circumferential surface of the drum wheel socket 28, 32 there are also parallel troughs $28_a$, $32_a$ which can couple with the parallel round prisms $27_a$, $30_a$. Thus the drum wheel joint can then be joined firmly. If the handle 10 is turned by force, them the tooth brush can be bent at the joint, and the sound is made when the parallel round prisms $27_a$, $30_a$ is turned and moved relatively to the parallel troughs $28_a$, $32_a$.

Figure 14:
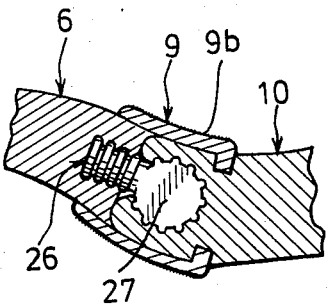
FIG. 14 is a partial sectional view of FIG. 13 in the assembled condition.
Figure 18:
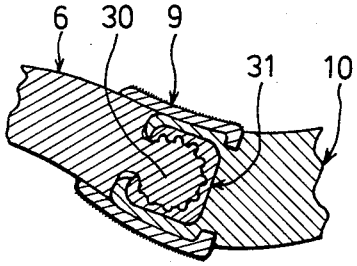
FIG. 18 is a partial view of the neck joint in section showing the assembled fixed drum joint.

The drum wheel joint may not be strong enough, then a sleeve 9 is applied same as in the ratchet ball joint (see FIGS. 14 and 18).

The drum wheel 27, 30 is inset into the neck 6 in two different ways. They are described as follows.

Figure 13:
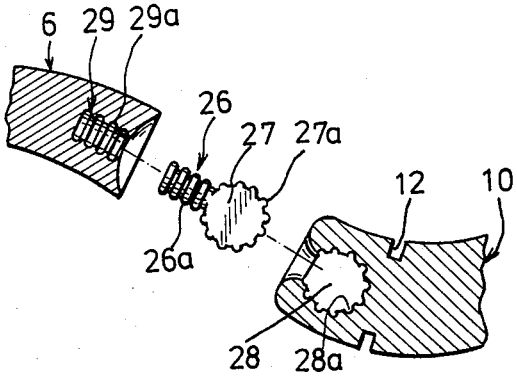
FIG. 13 is a partial sectional view of a fifth alternate neck joint unassembled showing a drum joint.
Figure 15:
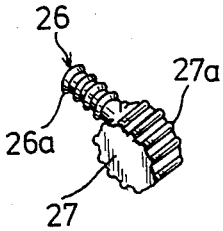
FIG. 15 is a perspective view of the turnable drum and turning axle of FIGS. 13 and 14.

(i) Turntable type:

FIGS. 13, 14, and 15 are referred.

At the back of the drum wheel 27 there is a turning axile 26 with a set of parallel turning axile protruded circles $26_a$ on it. At the right end of the neck 6 with a turning axile socket 29 there is a set of parallel troughs $29_a$ inside it. The axile 26 and the protruded circles $26_a$ are correspondent to the turning axile socket 29 and the troughs $29_a$, so that they can coupled firmly when the turning axile 26 is inset into socket 29 by force. Therefore this joint can be bent upward and downward and turned to any direction.

Figure 16:
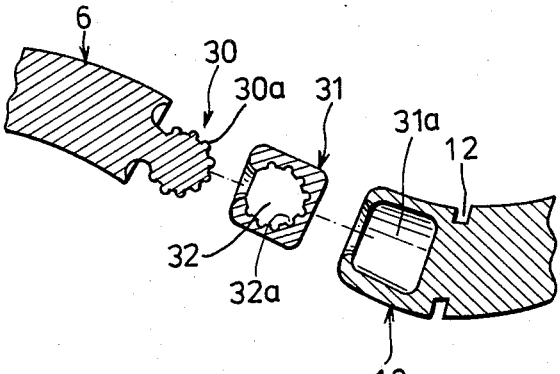
FIG. 16 is a partial sectional view of the joint unassembled showing a third modification.
Figure 17:
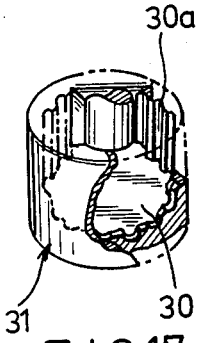
FIG. 17 is a perspective view in partial and drum wheel socket of FIG. 16.

(ii) Fixed type:

FIGS. 16, 17 and 18 are referred.

The drum 30 and the neck 6 are made in one piece. A drum wheel block 31 is prepared which is a shell in form. At the left end of the handle 10 there is a drum wheel block socket $31_a$ which can receive the drum wheel block 31. The drum wheel block 31 is allowed to turn in the drum wheel block socket $31_a$. Inside the drum wheel block 31 there is again a drum wheel socket 32 which can receive the drum wheel 30. When the three pieces, the drum wheel 30, the drum wheel block 31, and the handle 6 with the drum wheel socket $31_a$, are assembled well (see FIG. 18), this joint will then be coupled firmly. Thus this joint can be bent and turned to any direction.

The five different joints can also be used to join the turning pieces 1 to the main brush body to substitute the plain balls 2 and the plain ball sockets 4.

Figure 19:
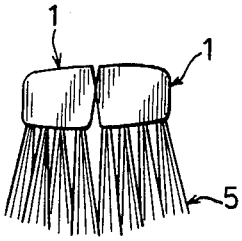
FIG. 19 is a front view of the brush area showing the curved and surface of the brush hairs or bristles.

FIG. 19 is the front view of the tooth brush in which the wavy curve along the master arc of the surface of the hairs is shown. This technical "planting hair" can achieve some special functions of brushing and cleaning.

Figure 20:
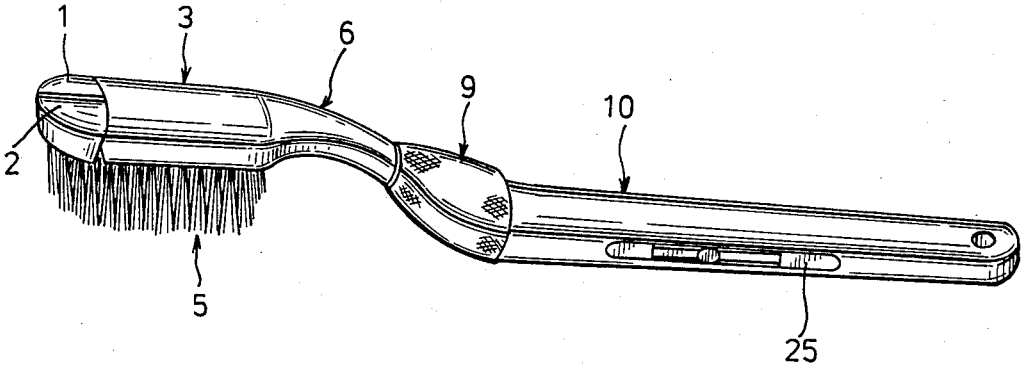
FIG. 20 is a perspective view of the present invention.

FIG. 20 is the perspective view of the present invention where shows the beauty in form and the practice in use.

A music I.C. plate 25 can be attached to one side of the handle 10 (see FIG. 20). The music will begin when the user's hand grips the handle 10, and the music will stop as the hand off. Therefore the user may acquire some relaxation during brushing and the children may get more interesting while brushing their teeth.

All the foregoing described joints can be applied to any other brushes with or without handles (only the joint at about the front ¼ of the brush body being applied).

I claim:

1. A toothbrush comprising a handle, a neck portion including a rear main brush portion, and two equally divided smaller front brush portions, said front and main brush portions having bristles extending downwardly therefrom, said front brush portions being about ¼ of the length, in the axial direction, of the main brush portion, the main brush portion being about ¾ths the length of the front and rear brush portions combined, each of the two smaller front brush portions having a joint to couple with the main brush body so that said small brush portions can be pivoted upwardly and downwardly or turned outwardly and inwardly, and a joint connected between the handle portion and the neck portion to allow the brush body to be pivoted or turned in any direction so as to be able to clean the hard-to-get-at areas of the teeth, thus increasing the brushing and cleaning efficiency of the toothbrush.

2. A toothbrush according to claim 1, wherein each of said front brush portions has a back portion in a direction towards said neck portion and the main brush portion has a front portion opposite said back portion, each of said joints on the front brush portions comprises a plain ball and the front portion of said main brush body being provided with two corresponding ball sockets, whereby, said two front brush portions couple with said main brush body so that external forces produced during use cause said front brush portions to be pivoted upwardly or downwardly or turned toward or away from each other.

3. A toothbrush according to claim 1, wherein said joint at said neck is formed of a ratchet ball and a corresponding ratchet ball socket, such that under an external force, the neck portion can be pivoted upwardly or downwardly or turned to any direction, and a sleeve member covering said neck joint to increase the strength of said neck joint.

4. A toothbrush according to claim 1, wherein said neck joint comprises a polyhedron ball and a corresponding polyhedron ball socket, such that under an external force, the neck portion can be pivoted upwardly or downwardly or turned in any direction, and a sleeve member covering said neck joint to increase the strength of said neck joint.

5. A toothbrush according to claim 1, wherein said neck joint comprises a circular flexible rod, each end of said rod being inserted in any of the handle or neck portion, such that said neck joint can be pivoted or turned in any direction under an external force, and a sleeve member covering said neck joint to increase the strength of said neck joint.

6. A toothbrush according to claim 5, wherein said flexible rod is substantially rectangular-shaped in cross section.

7. A toothbrush according to claim 1, wherein said neck joint comprises a drum-shaped wheel having parallel round prisms extending about the circumferential surface of said drum-shaped wheel and a corresponding drum-shaped wheel socket having parallel troughs on the circumferential surface of said drum-shaped wheel socket, such that the neck portion can be pivoted upwardly or downwardly or turned to any direction, and a sleeve member covering said neck joint to increase the strength of said neck joint.

8. A toothbrush according to claim 7, wherein said drum-shaped wheel is coupled to and enclosed by a shell-shaped drum wheel block, and a corresponding socket is provided at the end of the handle to retain said shell-shaped drum wheel block.

9. A toothbrush according to claim 7, wherein said drum wheel is provided with a cylindrical axle having a plurality of parallel circular ribs thereon, said axle being turnably retained in a correspondingly shaped socket in said neck portion.

10. A toothbrush according to claim 1, wherein the ends of said bristles form an arcuate surface extending along an axial direction of the toothbrush and the ends of the bristles forming a wavy-shaped configuration along said arcuate surface.

* * * * *